US005288029A

United States Patent [19]

Ishibashi et al.

[11] Patent Number: 5,288,029

[45] Date of Patent: Feb. 22, 1994

[54] APPARATUS FOR ELECTROSTATICALLY SPRAY-COATING WORKPIECE WITH PAINT

[75] Inventors: Ichirou Ishibashi; Toshio Kubota; Niichi Toyama; Shoko Sasaki; Yukihito Ono; Akihiko Tada, all of Sayama, Japan

[73] Assignee: Honda Giken Kogyo Kabushiki Kaisha, Tokyo, Japan

[21] Appl. No.: 785,262

[22] Filed: Oct. 30, 1991

[30] Foreign Application Priority Data

Nov. 8, 1990 [JP] Japan ..... 2-304465
Mar. 11, 1991 [JP] Japan ..... 3-013450[U]

[51] Int. Cl.[5] ..... B05B 5/02

[52] U.S. Cl. ..... 239/691; 239/690; 239/708; 239/112; 118/302

[58] Field of Search ..... 239/690, 691, 112, 708, 239/704, 705, 706, 707; 118/629, 302

[56] References Cited

U.S. PATENT DOCUMENTS 4,265,858 5/1981 Crum et al. ..... 422/129
4,771,729 9/1988 Planert et al. .
4,879,137 11/1989 Behr et al. ..... 239/112
4,881,563 11/1989 Christian ..... 118/302
5,094,389 3/1992 Giroux et al. ..... 118/629
5,096,126 3/1992 Giroux et al. ..... 239/690
5,102,045 4/1992 Diana ..... 118/302
5,102,046 4/1992 Diana ..... 239/708

FOREIGN PATENT DOCUMENTS 0303541 2/1989 European Pat. Off. .
3623877 7/1986 Fed. Rep. of Germany .
3717929 5/1987 Fed. Rep. of Germany .
2-2885 1/1990 Japan .
2246527 2/1992 United Kingdom .

*Primary Examiner*—Kevin P. Shaver
*Assistant Examiner*—Christopher G. Trainor

[57] ABSTRACT

An apparatus for electrostatically spray-coating a workpiece with conductive paint which includes a color changeover valve mechanism for selectively supplying conductive paint, cleaning liquid and air. A flush valve mechanism is provided for selectively supplying the cleaning liquid and the air. A first directional control valve includes an outlet and inlets. The inlets are connected to feed lines extending from the color changeover valve mechanism and the flush valve mechanism, respectively. A block line is made of an insulating material and has a first end connected to the outlet of the first directional control valve. The block line includes a second end in communication with the first end. A second directional control valve is provided having outlets and an inlet. The inlet is connected to the second end of the block line. An intermediate reservoir is connected via a feed line to one of outlets of the second directional control valve. A waste-liquid tank is connected via a first discharge line to a second outlet of the second directional control valve. A spray gun is connected via a delivery line to the intermediate reservoir. A second discharge line is branched from the delivery line via a changeover valve. A discharge line cleaning mechanism is provided for selectively supplying at least cleaning liquid and air to the second discharge line. A high voltage is applied to the conductive paint between the second directional control valve and the spray gun.

5 Claims, 12 Drawing Sheets

APPARATUS FOR ELECTROSTATICALLY SPRAY-COATING WORKPIECE WITH PAINT

BACKGROUND OF THE INVENTION

1. Field of the Invention

The present invention relates to an apparatus for directly applying a high voltage to conductive paint so as to electrostatically spray-coat an object or workpiece with the paint.

2. Description of the Related Art

An electrostatic spray coating or painting apparatus for applying a high voltage to conductive paint so as to electrostatically spray-coat an object or workpiece such as a vehicle body to be coated, with conductive paint, has heretofore been provided with an insulation mechanism for electrically insulating a color changeover valve mechanism as a paint feed source and an intermediate reservoir from each other. As a typical example, there is known a device as disclosed in U.S. Pat. No. 4,771,729, for example.

In the prior art shown in FIG. 1, there is disposed an insulation mechanism 6 between a color changeover valve mechanism 2 and an intermediate reservoir 4. When conductive paint is applied to an object or workpiece from a spray gun 8, the insulation mechanism 6 is activated to electrically insulate the color changeover valve mechanism 2 and the intermediate reservoir 4 from each other. The insulation mechanism 6 has an electrically-insulated line 10, which has a paint inlet and a paint outlet to which two-way changeover valves 12*a*, 12*b* are respectively connected. The insulated line 10 has upper and lower end portions to which two-way changeover valves 14*a*, 14*b* for introducing cleaning fluid or liquid into the insulated line 10 and for discharging the same therefrom, respectively, and two-way changeover valves 16*a*, 16*b* for introducing air into the insulated line 10 and for discharging the same therefrom, respectively, are connected.

In the prior art referred to above, however, the insulation mechanism 6 includes six two-way changeover valves 12*a*, 12*b*, 14*a*, 14*b*, 16*a* and 16*b*, and lines connected to given positions of the insulated line 10, for disposing the two-way changeover valves 14*a*, 14*b*, 16*a* and 16*b*. Therefore, the prior art has the following problem. More specifically, it is necessary to electrically insulate the two-way changeover valve 12*a* from the two-way changeover valve 12*b* and to reliably electrically separate the two-way changeover valve 12*b* from the two-way changeover valves 14*b*, 16*b*. Further, the insulation mechanism 6 and the entire structure of the electrostatic spray-painting apparatus with the insulation mechanism 6 incorporated therein are both extremely large and complex in addition to an increase in the number of changeover valves (two-way changeover valves) to be used. It is also hard to clean a path between the two-way changeover valves 12*a* and 14*a* and a path between the two-way changeover valves 12*b* and 16*b*. Further, cleaning liquid tends to remain in these paths, thereby requiring much drying time and providing unstable electrical insulation.

As this type of art, there is also known a paint color changeover system disclosed in Japanese Patent Application Laid-Open No. 2-2885, for example.

According to the disclosure, water-based conductive paint is first introduced into an intermediate reservoir from a paint feed source via an electrically-insulated line (insulated portion). Thereafter, the insulated line is washed and then dried to produce an electrically-insulated state (referred to as a "voltage block"). Thus, under the condition that current is being prevented from leaking to the paint feed source, the conductive paint is supplied to a spray gun from the intermediate reservoir, and a high voltage is directly applied to the conductive paint so as to electrostatically spray-coat an object or workpiece with the so-processed conductive paint.

In the disclosure referred to above, when it is desired to clean the insulated line, deionized water is used to prevent the current from leaking. It is, however, not possible to completely prevent the current from leaking even when deionized water is used. When the deionized water remains in the insulated line in the form of a thin film, current leakage is induced. Therefore, a high voltage cannot be applied to water-based coating or paint unless the deionized water employed in a cleaning process is completely dried. Thus, the formation of the voltage block will take much time, thereby impairing the efficiency of the entire spray painting process.

In order to produce the voltage block, either water or a solution obtained by mixing water with 5%–10% hydrophilic solvents is used as a cleaning liquid. However, the insulated line is washed with the cleaning liquid composed principally of the water, thereby causing a problem in detergency.

In the above disclosure as well, the insulated line is cleaned and then dried to produce the voltage block. Therefore, resin components in the water-based conductive paint tend to remain in the inner wall of the insulated line and adhere thereto when the process for producing the voltage block is repeatedly carried out. As a consequence, an undesired flow of electricity over or through the resin components adhered to the inner wall thereof is produced, and hence a voltage blocking effect is insufficient or incapable of being completely achieved. In addition, the resin components are separated from the inner wall so as to be delivered from the spray gun. As a consequence, there is risk that the resin components may be applied to the object or workpiece, thereby causing the problem of a painting failure.

SUMMARY OF THE INVENTION

It is a principal object of the present invention to provide an electrostatic spray-coating apparatus in which the time required to dry deionized water in particular can greatly be reduced, thereby making it possible to efficiently and easily carry out the entire spray painting process.

It is another principal object of the present invention to provide an electrostatic spray-coating apparatus by which the detergency of an insulated portion can be improved, thereby making it possible to easily reduce cleaning time so as to carry out an efficient spray painting process.

It is a further principal object of the present invention to provide an apparatus for electrostatically spray-coating an object or workpiece with paint, by which the accumulation of resin components of paint in an insulated portion can reliably be prevented, thereby making it possible to improve the detergency of the insulated portion and to prevent an undesired flow of electricity.

It is a still further principal object of the present invention to provide an electrostatic spray-coating apparatus capable of reducing the number of changeover valves to be used and providing an easy simplification of the structure of the apparatus and an excellent detergent effect.

It is another object of the present invention to provide an apparatus for electrostatically spray-coating a workpiece with paint, the apparatus uses the following steps of supplying a predetermined amount of water-based paint to an intermediate reservoir from a grounded water-based paint feed source through a feed line having an electrically-insulated portion formed in at least a part thereof, washing the electrically-insulated portion with deionized water having specific electric conductivity lower than given specific electric conductivity, removing the deionized water remaining in the electrically-insulated portion by using dry air after completion of the washing step so as to electrically insulate the water-based paint feed source from the intermediate reservoir, and supplying the water-based paint to a spray gun from the intermediate reservoir under the condition of the water-based paint feed source and the intermediate reservoir being electrically insulated from each other, thereby carrying out an electrostatic spray coating process.

It is a further object of the present invention to provide an apparatus wherein a cleaning process is carried out by making use of hot water as the deionized water, and the deionized water is removed by using dry air having a temperature lower than that of the deionized water.

It is a still further object of the present invention to provide an apparatus of electrostatically spray-coating a workpiece with paint, the apparatus uses the following steps of supplying water-based paint to an intermediate reservoir from a grounded water-based paint feed source through a feed line having an electrically-insulated portion formed in at least a part thereof, washing the electrically-insulated portion with only a hydrophilic solvent as cleaning liquid after completion of the water-based paint supplying step, removing the cleaning liquid remaining in the electrically-insulated portion by using dry air after completion of the washing step so as to electrically insulate the water-based paint feed source from the intermediate reservoir, and supplying the water-based paint to a spray gun from the intermediate reservoir under the condition of the water-based paint feed source and the intermediate reservoir being electrically insulated from each other, thereby carrying out an electrostatic spray coating process.

It is a still further object of the present invention to provide an apparatus wherein a butylcell solvent is used as the hydrophilic solvent.

It is a still further object of the present invention to provide an apparatus wherein isopropyl alcohol is used as the hydrophilic solvent.

It is a still further object of the present invention to provide an apparatus for electrostatically spray-coating a workpiece with paint, the apparatus uses the following steps of supplying water-based paint to an intermediate reservoir from a grounded water-based paint feed source through a feed line having an electrically-insulated portion formed in at least a part thereof, washing the electrically-insulated portion with cleaning liquid after completion of the water-based paint supplying step, followed by drying of the electrically-insulated portion, thereby electrically insulating the water-based paint feed source from the intermediate reservoir, supplying the water-based paint to a spray gun from the intermediate reservoir under the condition of the water-based paint feed source and the intermediate reservoir being electrically insulated from each other, thereby carrying out an electrostatic spray coating process, and after an electrostatic spray-painting cycle composed of the respective steps is carried out by a predetermined number of times, washing the electrically-insulated portion with a thinner solvent capable of dissolving resin components of the water-based paint, followed by further washing of the electrically-insulated portion with the cleaning liquid.

It is a still further object of the present invention to provide an apparatus for electrostatically spray-coating a workpiece with paint, the apparatus uses the following steps of supplying water-based paint to an intermediate reservoir from a grounded water-based paint feed source through a feed line having an electrically-insulated portion formed in at least a part thereof, washing the electrically-insulated portion with cleaning liquid after completion of the water-based paint supplying step, followed by drying of the electrically-insulated portion, thereby electrically insulating the water-based paint feed source from the intermediate reservoir, supplying the water-based paint to a spray gun from the intermediate reservoir under the condition of the water-based paint feed source and the intermediate reservoir being electrically insulated from each other, thereby carrying out an electrostatic spray coating process, and when the value of leakage current flowing through the electrically-insulated portion is measured and the value thus measured is more than or equal to the reference value, washing the electrically-insulated portion with a thinner solvent capable of dissolving resin components of the water-based paint after completion of the electrostatic spray coating process, followed by further washing of the electrically-insulated portion with the cleaning liquid.

It is a still further object of the present invention to provide an apparatus for electrostatically spray-coating a work with paint, the apparatus comprising a color changeover valve mechanism for selectively supplying conductive paint, cleaning liquid and air, a flush valve mechanism for selectively supplying the cleaning liquid and the air, a first directional control valve having inlets connected to feed lines extending from the color changeover valve mechanism and the flush valve mechanism, respectively, a block line made of an insulating material and having one end connected to an outlet of the first directional control valve, a second directional control valve having an inlet connected to the other end of the block line, an intermediate reservoir connected via a feed line to one of outlets of the second directional control valve, a waste-liquid tank connected via a discharge line to the other of the outlets of the second directional control valve, a spray gun connected via a delivery line to the intermediate reservoir, and a second discharge line branched from said delivery line via a changeover valve, a discharge line cleaning mechanism for selectively supplying at least cleaning liquid and air to said second discharge line, said discharge line cleaning mechanism being provided separately from said flush valve mechanism for said supply line and said delivery line and connected to said second discharge line on the downstream side of said changeover valve, and means for applying a high voltage to the conductive paint between the second directional control valve and the spray gun.

It is a still further object of the present invention to provide an apparatus for electrostatically spray-coating a work with paint, the apparatus comprising a grounded conductive paint feed source, an intermediate reservoir for temporarily storing conductive paint therein and for delivering the conductive paint stored therein to a spray gun, and an insulation mechanism for electrically insulating the conductive paint feed source from the intermediate reservoir, the insulation mechanism comprising a first three-way changeover valve having first and second ports connected to the conductive paint feed source and a flush valve respectively, and a third port connected to one end of an insulated line and capable of selectively communicating with the first and second ports, and a second three-way changeover valve having a fourth port connected to the other end of the insulated line, and fifth and sixth ports connected to the intermediate reservoir and a waste-liquid tank respectively and capable of selectively communicating with the fourth port, a spray gun connected via a delivery line to said intermediate reservoir, a discharge line branched from said delivery line via a changeover valve, a discharge line cleaning mechanism for selectively supplying at least cleaning liquid and air to said discharge line, said discharge line cleaning mechanism being provided separately from said flush valve mechanism for said supply and delivery lines and connected to said discharge line on the downstream side of said changeover valve, and means for applying a high voltage to the conductive paint between said second three-way changeover valve and said spray gun.

It is a still further object of the present invention to provide an apparatus for electrostatically spray-coating a work with paint, the apparatus comprising a grounded water-based conductive paint feed source, an intermediate reservoir for temporarily storing water-based conductive paint therein and for delivering the water-based conductive paint stored therein to a spray gun, conductive paint feed means for supplying the water-based conductive paint to the intermediate reservoir from the water-based conductive paint feed means, the conductive paint feed means having an electrically-insulated portion formed in at least a part thereof, means for washing the electrically-insulated portion with cleaning liquid, means for drying the electrically-insulated portion, leakage current measuring means provided on said electrically-insulated portion, wherein thinner solvent for removing a resin component of the conductive paint remaining in said electrically-insulated portion can be supplied from said means for washing said electrically-insulated portion into said electrically-insulated portion when a measured value outputted by said leakage current measuring means exceeds a predetermined value, and thinner solvent feed means for supplying thinner solvent to remove resin components of the conductive paint, which remain in the electrically-insulated portion.

It is a still further object of the present invention to provide the apparatus wherein the conductive paint feed means includes a block valve mechanism for electrically insulating the conductive paint feed source and the intermediate reservoir from each other.

It is a still further object of the present invention to provide an apparatus for electrostatically spray-coating a work with conductive paint, the apparatus comprising a grounded conductive paint feed source, an intermediate reservoir for temporarily storing conductive paint therein and for delivering the conductive paint stored therein to a spray gun, conductive paint feed means for supplying the conductive paint to the intermediate reservoir from the conductive paint feed source, the conductive paint feed means having an electrically-insulated portion formed in at least a part thereof, a changeover valve for controlling the flow of the conductive paint, a discharge line connected to the changeover valve, for discharging waste liquid outwardly of a line for supplying the conductive paint to the spray gun, and an air feed mechanism for supplying dry air to the discharge line.

The above and other objects, features and advantages of the present invention will become apparent from the following description and the appended claims, taken in conjunction with the accompanying drawings in which preferred embodiments of the present invention are shown by way of illustrative example.

BRIEF DESCRIPTION OF THE DRAWINGS

The present invention will become more fully understood from the detailed description given hereinbelow and the accompanying drawings which are given by way of illustration only, and thus are not limitative of the present invention, and wherein.

DETAILED DESCRIPTION OF THE PREFERRED EMBODIMENTS

Figure 1:
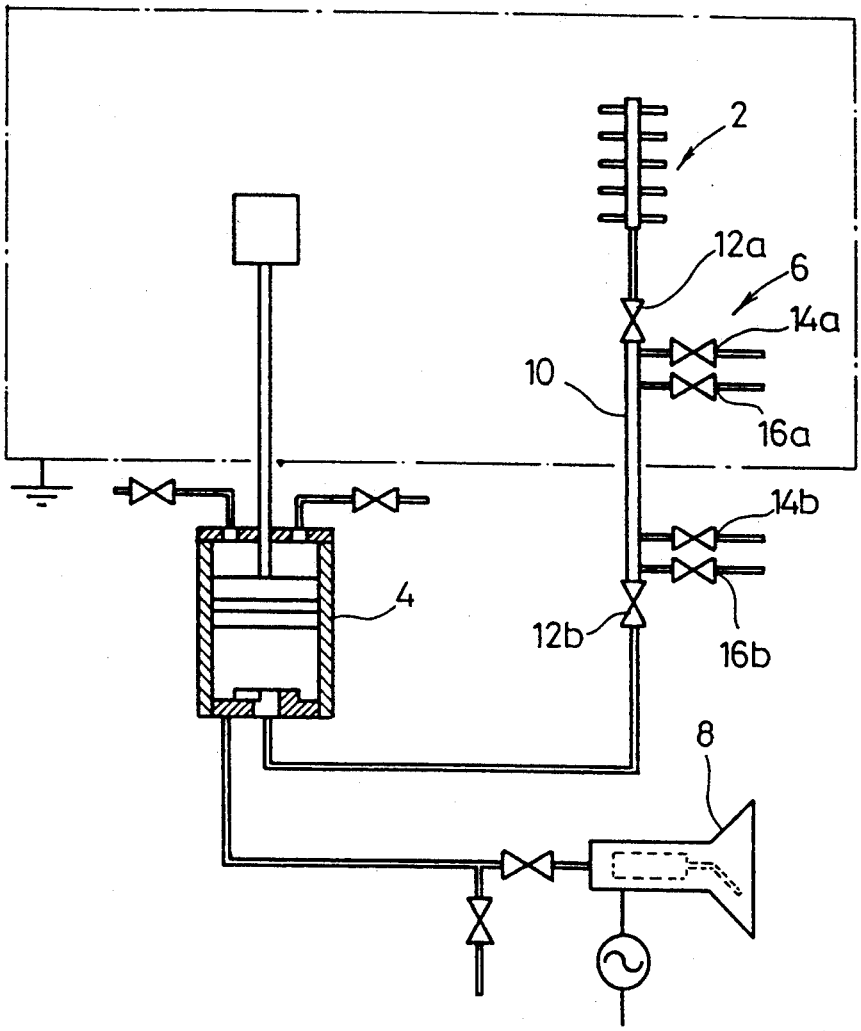
FIG. 1 PRIOR ART
FIG. 1 is a diagram schematically showing an electrostatic spray painting apparatus in which a conventional insulation mechanism is incorporated.
Figure 2:
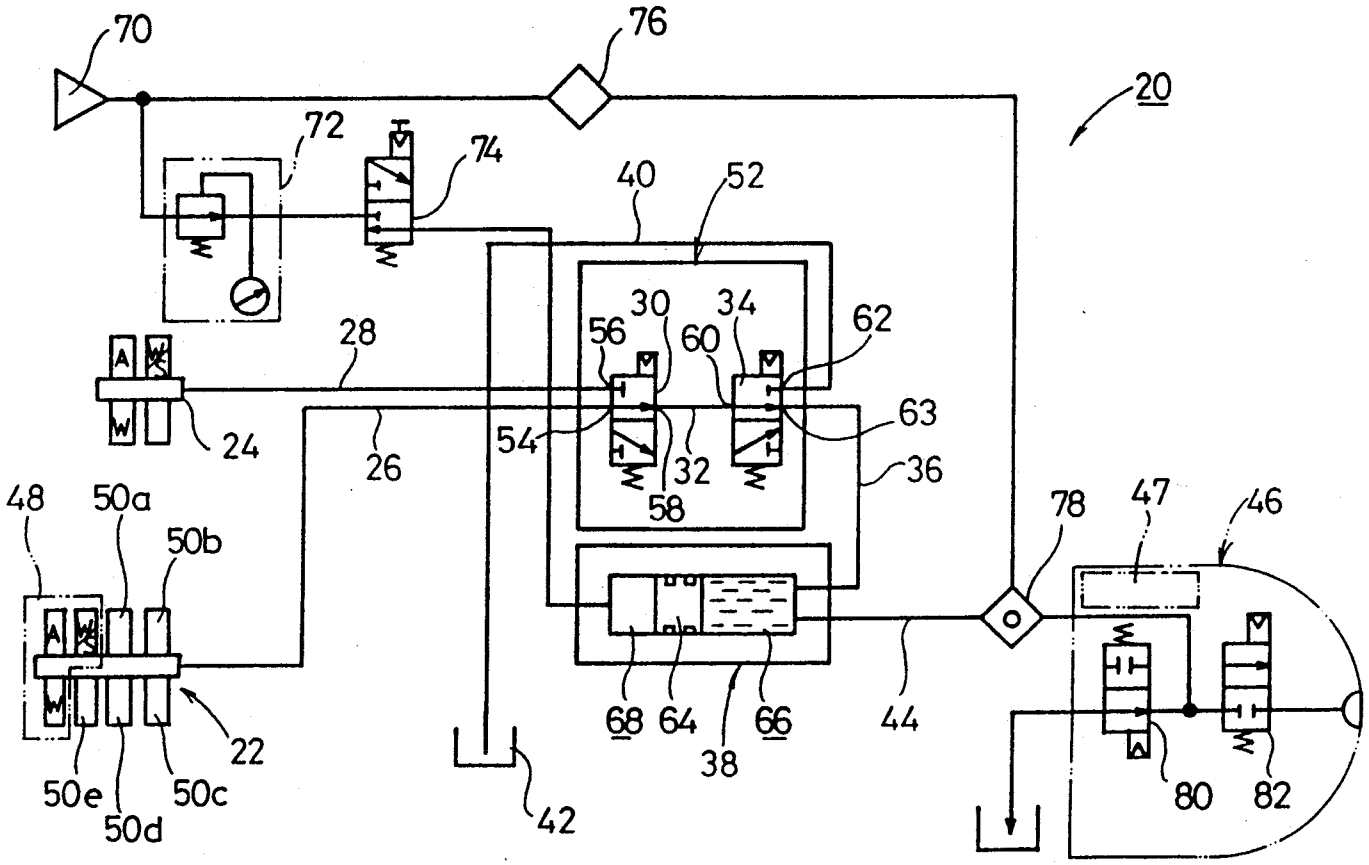
FIG. 2 is a diagram schematically showing the structure of an electrostatic spray painting apparatus for carrying out an electrostatic spray painting method according to a first embodiment of the present invention.
Figure 3:
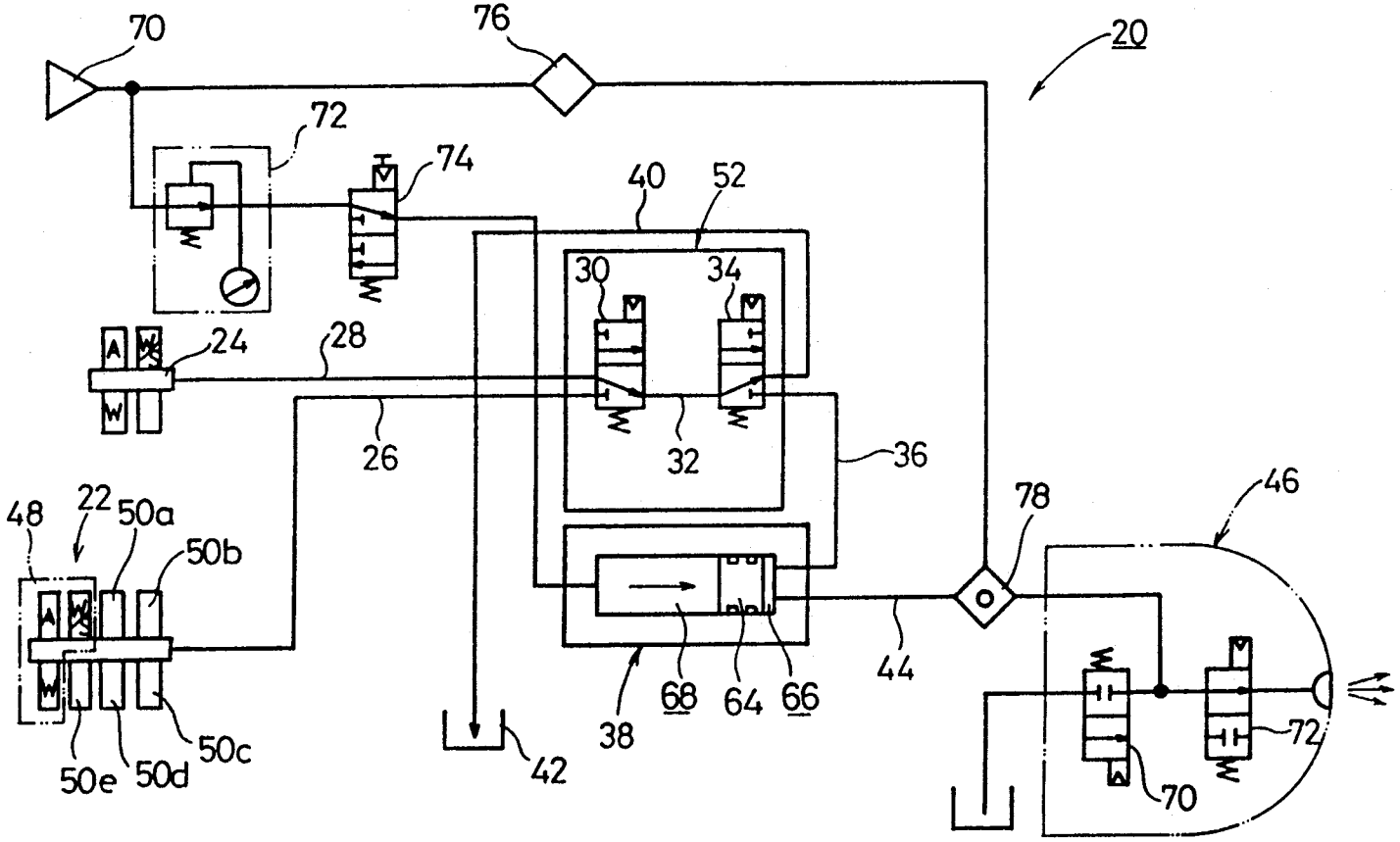
FIG. 3 is a diagram for describing the operation of the electrostatic spray painting apparatus.

Referring to FIGS. 2 and 3, designated at numeral 20 is an electrostatic spray coating or painting apparatus according to a first embodiment of the present invention. The electrostatic spray painting apparatus 20 comprises a grounded color changeover valve mechanism (paint feed source) 22, a flush valve mechanism 24 for selectively supplying air (A), deionized water (W) and cleaning liquid (S) or the like, a first three-way changeover valve (directional control valve) 30 whose inlets are coupled to feed lines 26, 28 which extend from the color changeover valve mechanism 22 and the flush valve mechanism 24 respectively, an electrically-insulated block line (insulated line) 32 made of a resin such as polytetrafluoroethylene (PTFE) and whose one end is coupled to an outlet of the first three-way changeover valve 30, a second three-way changeover valve (directional control valve) 34 whose inlet is coupled to the other end of the block line 32, an intermediate reservoir (intermediate storage portion) 38 coupled via a feed line 36 to an outlet of the second three-way changeover valve 34, a waste-liquid tank 42 coupled to another outlet of the second three-way changeover valve 34 through a discharge line 40, a spray gun 46 connected via a delivery line 44 to the intermediate reservoir 38, and a high-voltage applying means 47 for applying a high voltage to conductive paint between the second three-way changeover valve 34 and the spray gun 46.

The color changeover valve mechanism 22 includes a flush valve 48 for controlling the supply of the air (A), the deionized water (W), the cleaning liquid (S), etc., and a plurality of paint valves 50*a* through 50*e* capable of supplying different paints. A block valve mechanism 52 is composed of the first three-way changeover valve 30 disposed between the color changeover valve mechanism 22 and the intermediate reservoir 38, the block line 32 and the second three-way changeover valve 34. The first three-way changeover valve 30 on the inlet side of the block valve mechanism 52 has first and second ports 54, 56 to which the color changeover valve mechanism 22 and the flush valve mechanism 24 for controlling the supply of the air (A), the deionized water (W), the cleaning liquid (S), etc. are respectively coupled, and a third port 58 coupled to one end of the block line 32 and capable of selectively communicating with the first and second ports 54, 56. On the other hand, the second three-way changeover valve 34 on the outlet side of the block valve mechanism 52 includes a fourth port 60 coupled to the other end of the block line 32, and fifth and sixth ports 62, 63 respectively coupled to the waste-liquid tank 42 and the intermediate reservoir 38 and capable of selectively communicating with the fourth port 60.

The intermediate reservoir 38 has a first cylinder chamber 66 compartmented by a piston 64 and used for the injection of paint, cleaning liquid, etc., and a second cylinder chamber 68 used for the supply of air. In addition, an air feed source 70 communicates with the second cylinder chamber 68 via a flow control valve 72 and an on-off valve 74. The air feed source 70 is connected via a booster 76 to a paint flow control device 78 for controlling the pressure of air. The flow control device 78 permits the control of the delivery rate of paint, and is mounted on the delivery line 44.

The spray gun 46 has a dump valve 80 and a trigger valve 82, and is electrically connected to the known high-voltage applying means 47.

The operation of the electrostatic spray painting apparatus 20 constructed as described above will now be described below in conjunction with an electrostatic spray coating or painting method according to the first embodiment.

When paint of a predetermined color is pressure fed from the paint valve 50*a* of the color changeover valve mechanism 22 upon execution of an electrostatic spray painting process by the electrostatic spray painting apparatus 20, the paint successively passes through the first and third ports 54, 58 of the first three-way changeover valve 30 and the block line 32, and is thereafter supplied to the fourth port 60 of the second three-way changeover valve 34. Further, the paint is delivered to the intermediate reservoir 38 from the sixth port 63 (see FIG. 2).

The paint, with which the first cylinder chamber 66 of the intermediate reservoir 38 is charged, passes through the delivery line 44 until the spray gun 46 is filled therewith. Upon charging of the spray gun 46 with the paint, the trigger valve 82 is closed and the dump valve 80 is opened. After completion of the charging of the spray gun 46 with the paint, the dump valve 80 is closed.

Figure 4:
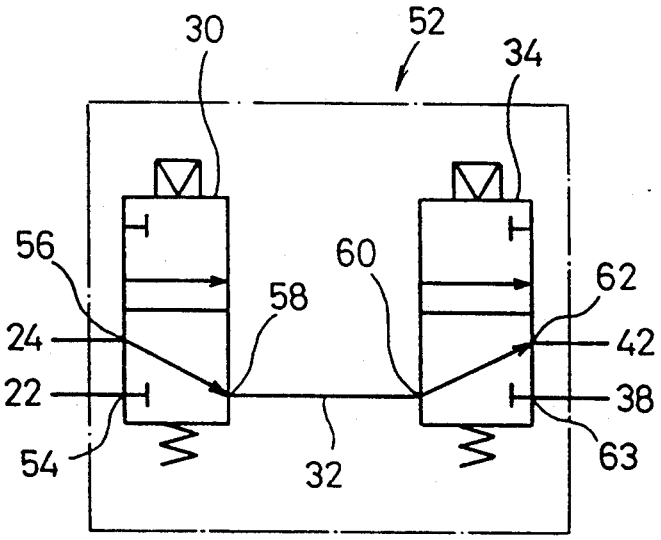
FIG. 4 is a diagram schematically showing the structure of a block valve mechanism.

Then, the action of turning the first and second three-way changeover valves 30, 34 of the block valve mechanism 52 on and off is carried out to cause the second port 56 to communicate with the third port 58 and to cause the fourth port 60 to communicate with the fifth port 62 respectively (see FIGS. 3 and 4). Under this condition, the flush valve mechanism 24 is actuated to supply cleaning liquid to the first three-way changeover valve 30. Then, the cleaning liquid and the deionized water supplied thereto wash the block line 32 so as to be discharged into the waste-liquid tank 42 through the discharge line 40. Thereafter, the block valve mechanism 52 is dried, thereby making it possible to electrically insulate the color changeover valve mechanism 22 from the intermediate reservoir 38.

Then, drive air is supplied from the air feed source 70 to the second cylinder chamber 68 of the intermediate reservoir 38 through the flow control valve 72 and the on-off valve 74 so as to displace the piston 64 toward the first cylinder chamber 66. As a consequence, the paint is applied to an unillustrated work under the on-action of the trigger valve 82 in a state in which a high voltage is being applied to the paint by the high-voltage applying means 47.

In the present embodiment, the block line 32 of the block valve mechanism 52 is washed with the deionized water having specific electric conductivity smaller than given specific electric conductivity by way of the flush valve mechanism 24, thereby making it possible to carry out a process for drying (removing) the deionized water in a short period of time at a time.

Figure 5:
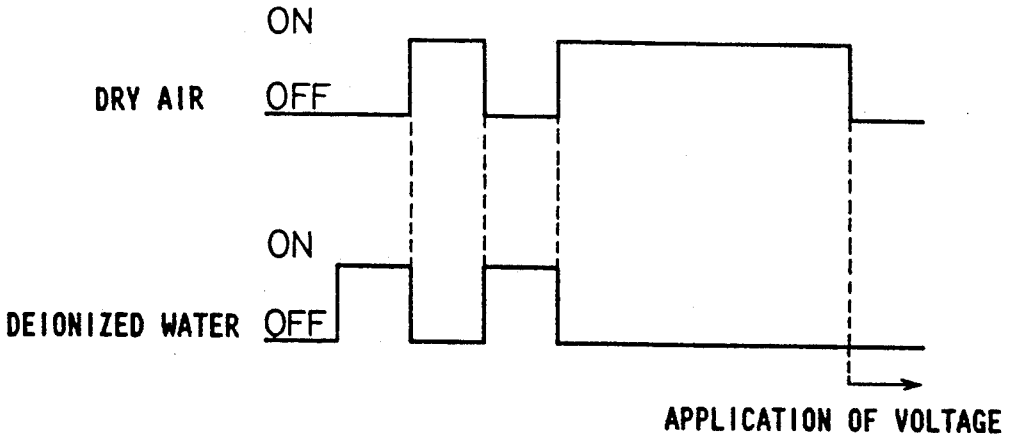
FIG. 5 is a timing chart for describing cleaning and drying patterns based on the electrostatic spray painting method.

More specifically, the specific electric conductivity of the deionized water is changed and the time required to carry out the action of a voltage block is measured under the condition that the voltage to be applied to the paint is of −60 kV, the block line 32 having an inside diameter of 6 mm and a length of 20 cm is used, and the deionized water is dried by dry air (having a dew-point temperature of 20° C.) having a temperature of 20° C. In this case, the deionized water and the dry air are alternately supplied as illustrated by patterns in FIG. 5.

As a result, a desired voltage block could be achieved by conducting the drying process for 12 seconds where deionized water having a specific electric conductivity of 1.0 μs (siemens) is used, with the result that the inside of the block line 32 has completely been dried. On the other hand, when deionized water having a specific electric conductivity of 0.1 μs is used, a satisfactory voltage block could be formed by conducting the drying process for 4 seconds. Furthermore, even when deionized water having a specific electric conductivity of 0.03 μs is used, a satisfactory voltage block could be created by conducting the drying process for 3 seconds. However, the inside of the block line 32 has not been dried completely, and the deionized water still remained in thin-film form. It was thus verified that the voltage block could be formed in a short period of time by making use of the deionized water having low specific electric conductivity.

Figure 6:
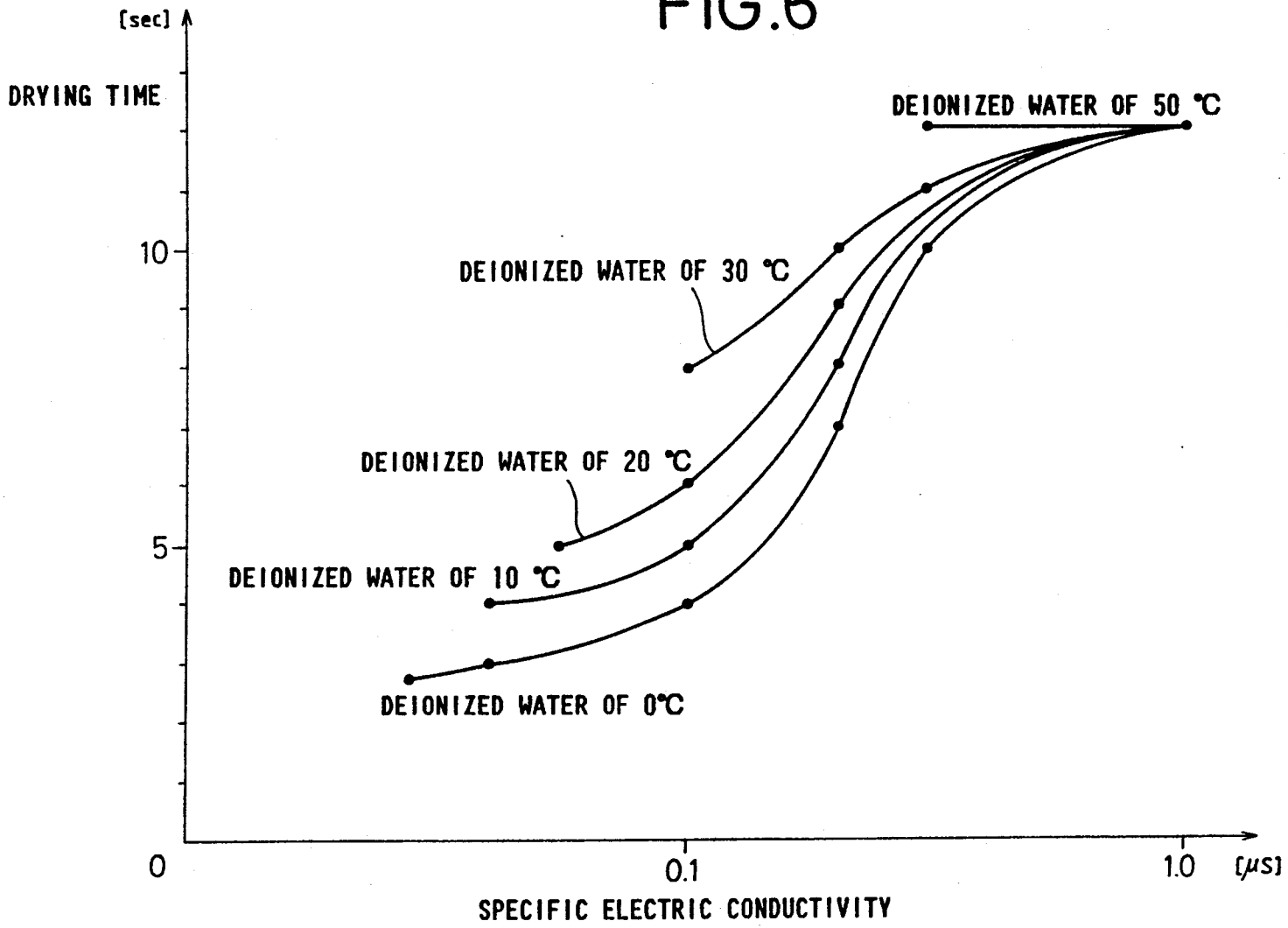
FIG. 6 is a diagram showing the relationship between the temperature of deionized water and the specific electric conductivity vs. drying time.
Figure 7:
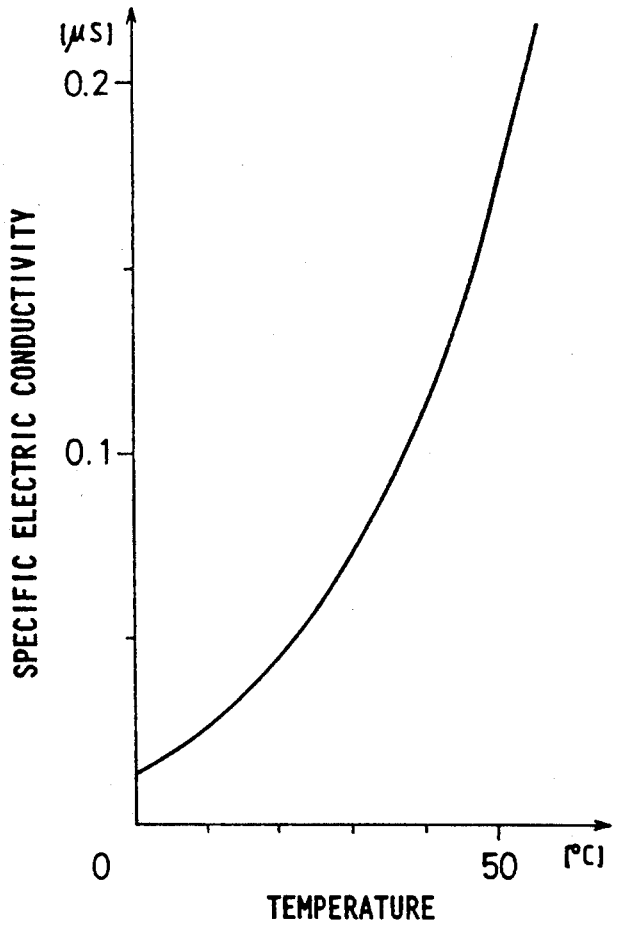
FIG. 7 is a diagram illustrating the relationship between the temperature of deionized water and the specific electric conductivity.

As shown in FIGS. 6 and 7, the specific electric conductivity of the deionized water varies with temperature. The specific electric conductivity thereof increases with an increase in temperature of the deionized water, and the drying time is long. It is therefore necessary to set the temperature of the deionized water as low as possible in consideration of insulating characteristics. However, it is desired that the temperature of the deionized water is set to a relatively high temperature in consideration of detergency. Thus, excellent detergency and insulating characteristics can be obtained by using deionized water composed of hot water of 35° C. or above as cleaning liquid and by making use of dry air at a low temperature, preferably, at a temperature of 20° C. or below. As a consequence, the voltage block can be formed in a short period of time, thereby making it possible to efficiently and easily carry out the entire coating process.

In the present embodiment as well, the block valve mechanism 52 disposed between the color changeover valve mechanism 22 and the intermediate reservoir 38 includes the block line 32, and the first and second three-way changeover valves 30, 34 connected to both ends of the block line 32. Thus, only two changeover valves, i.e., the first and second three-way changeover valves 30, 34 may actually be disposed. It is therefore possible to reduce the number of changeover valves at a time as compared with a conventional insulation mechanism with a plurality of two-way changeover valves (e.g., six changeover valves) being disposed therein.

It is also unnecessary to cause an arbitrary portion of the block line 32 to branch or divide up as when conventional two-way changeover valves are used. Even when it is caused to branch, a consideration as to the insulation or the like against the resultant branch lines is also unnecessary. Thus, the block valve mechanism 52 can be brought into a reliably insulated state. In addition, the construction of the block valve mechanism 52 can easily be simplified.

Further, the color changeover valve mechanism 22 and the flush valve mechanism 24 are directly coupled via their corresponding feed lines 26, 28 to the first three-way changeover valve 30. In addition, the intermediate reservoir 38 and the waste-liquid tank 42 are respectively coupled directly to the second three-way changeover valve 34 via the feed line 36 and the discharge line 40. Therefore, the entire structure of the electrostatic spray painting apparatus 20 can be simplified at one time.

Figure 8:
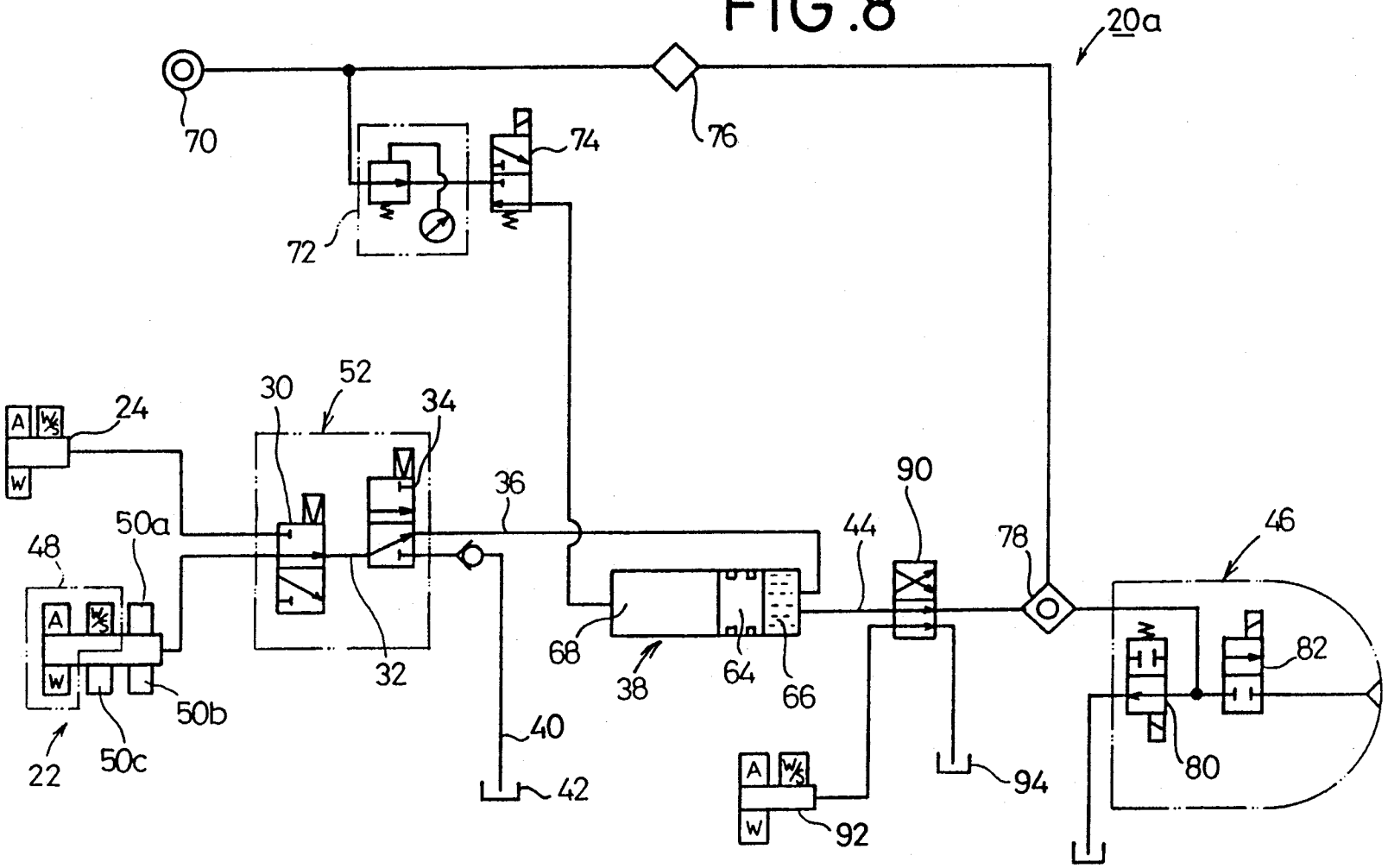
FIG. 8 is a diagram schematically depicting a modification of the electrostatic spray painting apparatus for carrying out the electrostatic spray painting method according to the first embodiment.

In the present embodiment, the flow control device 78 is coupled to the delivery line 44 which extends from the intermediate reservoir 38. However, a four-way changeover valve 90 may be connected to the delivery line 44 as shown in FIG. 8. The four-way changeover valve 90 is constructed in such a manner that a flush valve mechanism 92 for controlling the supply of air (A), deionized water (W), cleaning liquid (S), etc. and a waste-liquid tank 94 are connected thereto, thereby washing the spray gun 46.

A description will now be made of an electrostatic spray painting method according to a second embodiment of the present invention. Incidentally, this method can be carried out using the electrostatic spray painting apparatus 20 shown in FIGS. 2 through 4.

Figure 9:
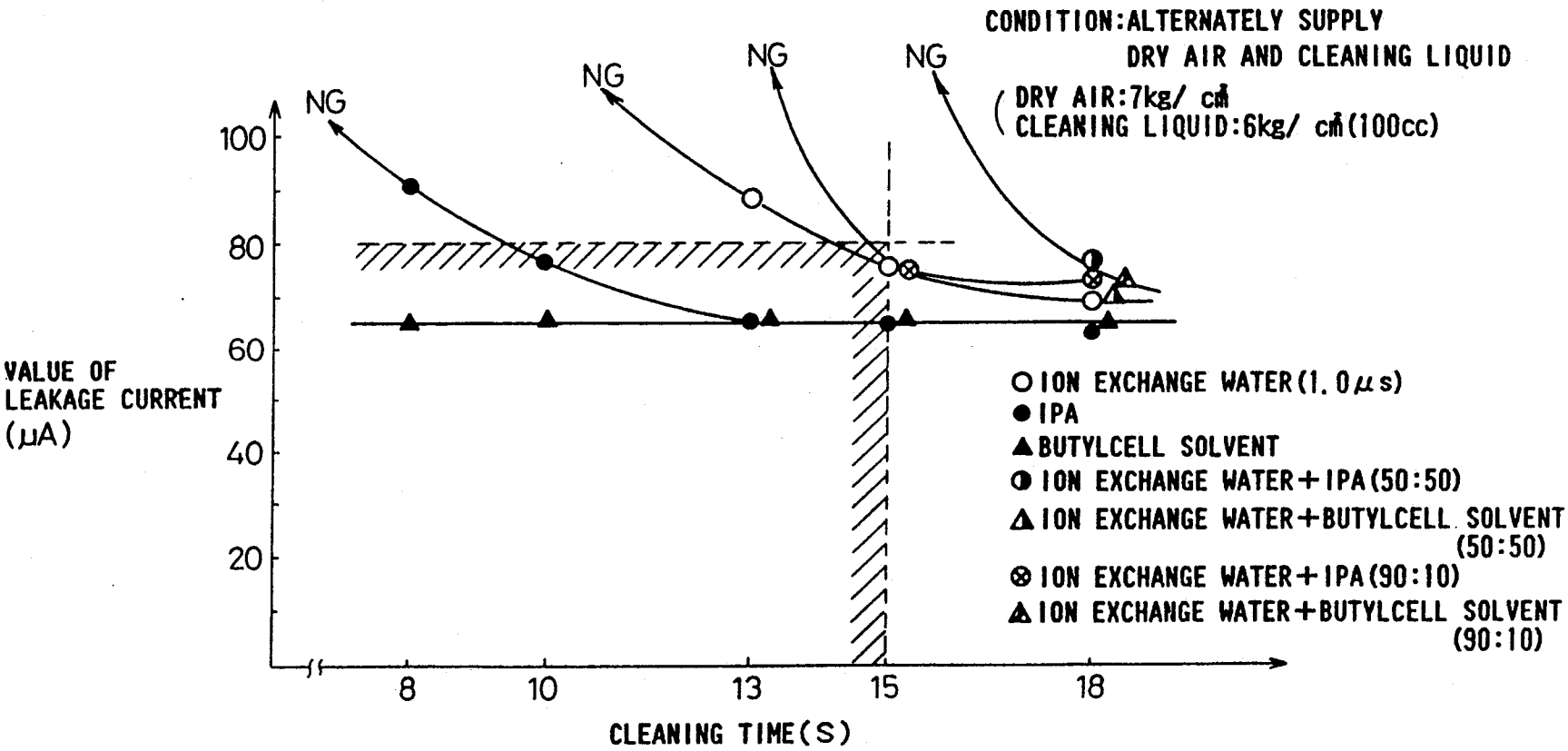
FIG. 9 is a diagram showing the relationship between the time required to wash a desired part with cleaning liquid employed in an electrostatic spray painting method according to a second embodiment and the value of leakage current.
Figure 10:
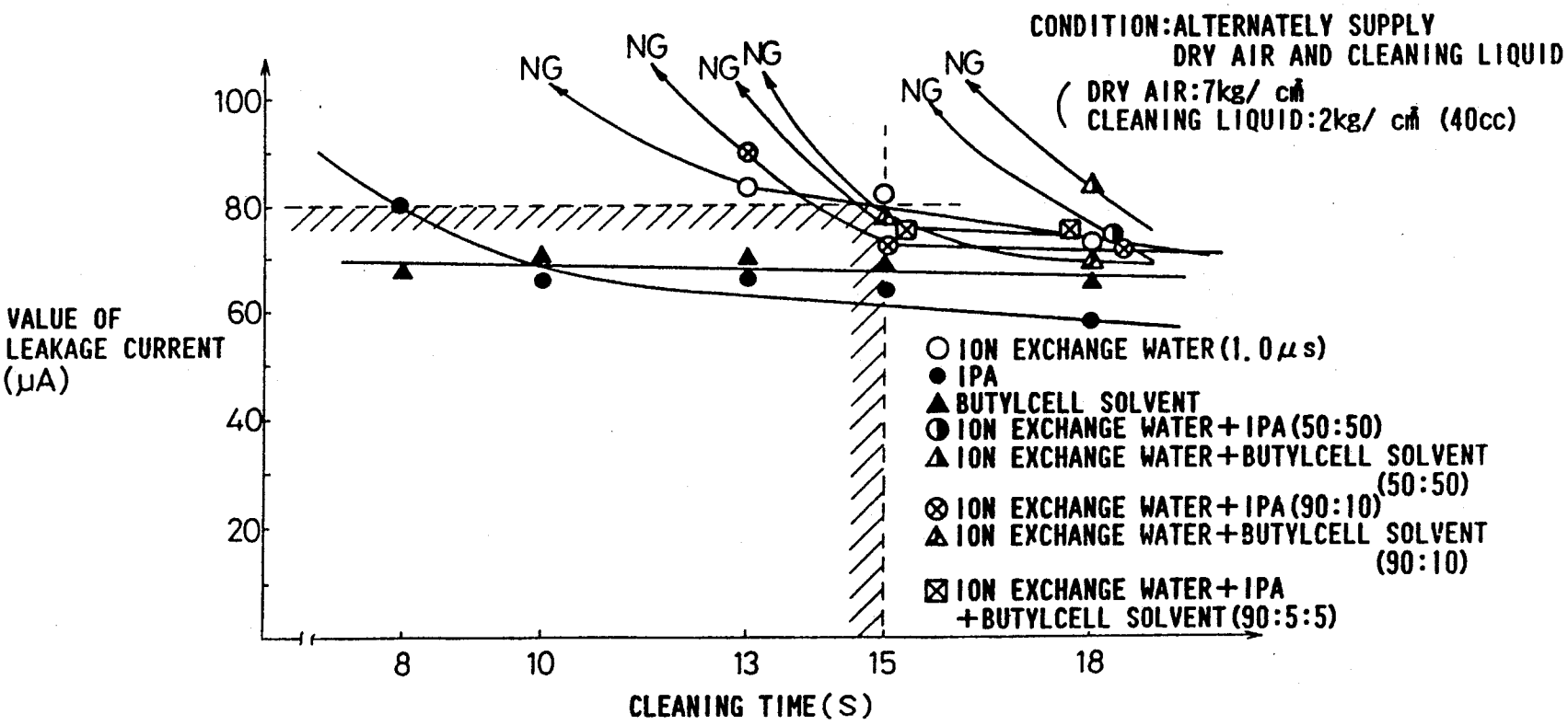
FIG. 10 is a diagram illustrating the relationship between the time required to wash a desired part with cleaning liquid employed under conditions different from those shown in FIG. 9 and the value of leakage current.

In the present embodiment, the time required to clean the block valve mechanism 52 can be shortened at a time by singly using, as cleaning liquid, hydrophilic solvents such as either a butylcell solvent or isopropyl alcohol, etc. More specifically, as cleaning liquid, is singly used ion exchange water, a butylcell solvent and isopropyl alcohol respectively. In addition, a mixture of the ion exchange water and the butylcell solvent and/or the isopropyl alcohol is used as the cleaning liquid. Under this condition, the relationship between the time required to wash the block valve mechanism 52 with each cleaning liquid referred to above and each value of leakage current induced at the time of application of a high voltage to paint has been obtained experimentally. The results thus obtained are shown in FIGS. 9 and 10. The cleaning time shows the sum of time intervals required to alternately supply dry air and cleaning liquid.

According to the results, when the cleaning process is carried out by using only the ion exchange water, the specific electric conductivity of the ion exchange water is high (about 1.0 μs). Therefore, the moisture or water in the block line 32 must fully be dried by dry air, thereby requiring much time to dry the water. Accordingly, when it is desired to cause a leakage current value to be 80 (μA) or below, for example, the cleaning time shall be at least 15 (seconds) to 18 (seconds) as a whole.

On the other hand, when the cleaning process is performed by making use of either the butylcell solvent or the isopropyl alcohol alone, its detergent action is superb as compared with that of the ion exchange water, thereby making it possible to reduce the time required to wash the block valve mechanism at a time. Further, the electrical conductivity of either the bytylcell solvent or the isopropyl alcohol is lower than that of the ion exchange water. It is therefore feasible to create a suitable electrically-insulated state even though the moisture or water in the block line 32 is not completely dried. As a consequence, the entire cleaning time can easily be reduced, and the entire spray coating process can efficiently be carried out.

Then, an electrostatic spray painting method according to a third embodiment of the present invention will now be described below. Incidentally, the reference numerals employed in an electrostatic spray painting apparatus according to the third embodiment, which are identical to those employed in the electrostatic spray painting apparatus 20 shown in FIGS. 2 and 8, denote the same elements of structure as those in the electrostatic spray painting apparatus 20, and their detailed description will therefore be omitted.

Figure 11:
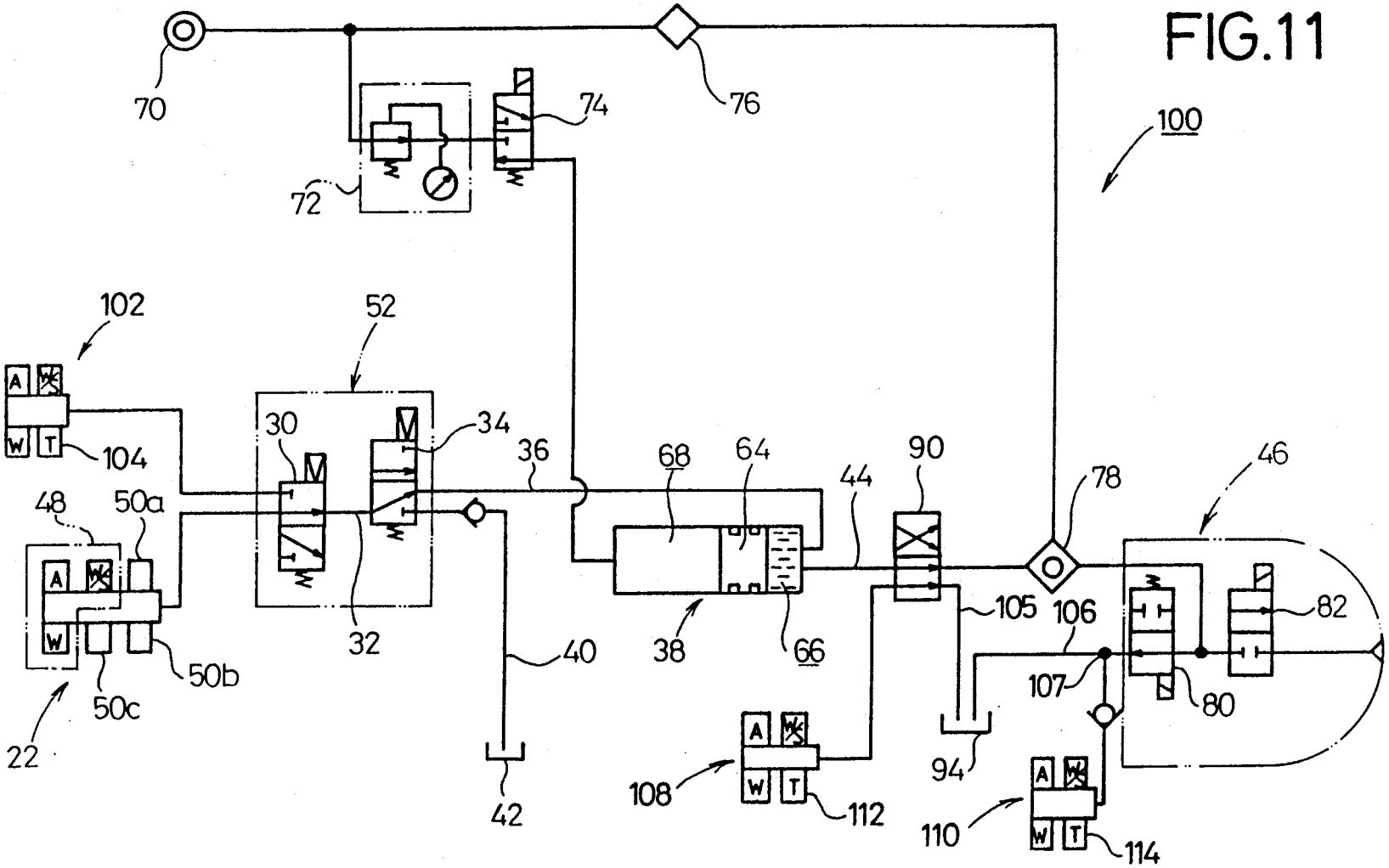
FIG. 11 is a diagram schematically showing an electrostatic spray painting apparatus for carrying out an electrostatic spray painting method according to a third embodiment of the present invention.

As shown in FIG. 11, an electrostatic spray painting apparatus 100 used to execute the electrostatic spray painting method according to the third embodiment of the present invention has a first flush valve mechanism 102. The first flush valve mechanism 102 is provided with a thinner feed valve 104 as a thinner solvent feed means, for removing resin components of water-based paint which remain at least in the block line 32.

Second and third flush valve mechanisms 108, 110 are respectively connected to a discharge line 105 coupled to the four-way changeover valve 90 and a discharge line 106 coupled to a dump valve 80 as a changeover valve. The second and third flush valve mechanisms 108, 110 have thinner feed valves 112, 114 respectively. The discharge lines 105, 106 are used to discharge waste liquid including conductive paint and cleaning liquid, which is produced at the time of the cleaning, to the outside of the delivery line 44 as a line or path. The second and third flush valve mechanisms 108, 110 each have a function as an air feed mechanism for supplying dry air to each of the discharge lines 105, 106.

When an electrostatic spray painting cycle comprising a process for charging the intermediate reservoir 38 with paint, a process for cleaning and drying the block line 32, and a process for delivering paint from the spray gun 46 is repeatedly carried out, the resin components in the paint may remain in the block line 32 and adhere thereto. In order to avoid this, the present embodiment is constructed in such a manner that after the above cycle is carried out by a predetermined number of times, a thinner such as acetone, toluene, etc. is supplied via the first three-way changeover valve 30 to the block line 32 from the thinner feed valve 104 of the first flush valve mechanism 102. Therefore, the resin components, which have been adhered to the inside of the block line 32, are reliably dissolved with the thinner, so that they are discharged via the discharge line 40 to the waste-liquid tank 42 from the second three-way changeover valve 34.

Thus, the present embodiment can reliably solve the problems that when a high voltage is directly applied to paint, an undesired flow of electricity over or through the resin components remaining in the block line 32 is produced, and the resin components solidified are separated or released from the block line 32 so as to be adhered to a work. Since the resin components are insoluble in water in particular, they cannot be fully removed by the water, and the cleaning liquid composed of a mixture of water and solvent, both of which have heretofore been used. However, in the present embodiment, the thinner referred to above is used, thereby making it possible to fully remove this kind of resin components. As a consequence, the electrostatic spray painting process can be carried out highly accurately and efficiently.

After the block line 32 has been washed with the thinner, either the water or the mixture of the water and the solvent is then supplied to the block line 32 from the first flush valve mechanism 102, thereby making it possible to remove the thinner from the block line 32. It is therefore possible to prevent a failure in painting such as a ceasing from occurring by the thinner remaining in the block line 32.

When either the paint valve **50*b* or 50*c* is selected alternative to the paint valve 50*a* of the color changeover valve mechanism 22, a process for cleaning the feed line 36, the intermediate reservoir 38 and the spray gun 46 or the like is carried out. At this time, unnecessary waste liquid is introduced into the discharge lines 105, 106. Therefore, there is the possibility of the resin components of the paint being adhered to the inside of each of the discharge lines 105, 106 when a process for changing the color of the paint used at present to another is repeatedly carried out. Thus, after the cleaning process for the color changeover is performed by a predetermined number of times, the thinner feed valve 112 of the second flush valve mechanism 108 is actuated to cause the four-way changeover valve 90 to supply the thinner to the discharge line 105. Then, the discharge line 105 is cleaned, and hence all the thinners in the discharge line 105 are discharged into the waste-liquid tank 94. On the other hand, the thinner feed valve 114 of the third flush valve mechanism 110 is actuated to remove the resin components in the discharge line 106**.

The cleaning liquid used for the cleaning process referred to above and unnecessary conductive paint are discharged into the waste-liquid tank 94 from the discharge line 106 coupled to the dump valve 80. However, some of them tends to remain in the inner wall of the discharge line 106. Therefore, the present embodiment takes the following measure to solve this problem. More specifically, the third flush vale mechanism 110 is coupled via a joint member 107 to the discharge line 106. After completion of the cleaning process, the dump valve 80 is closed, and the third flush valve mechanism 110 is actuated to discharge air therefrom. Thereafter, the air is supplied to the joint member 107 where it is diverted into the discharge line 106. The air introduced into the discharge line 106 serves to dry the discharge line 106, followed by discharging into the waste-liquid tank 94.

Accordingly, the discharge line 106 extending from the joint member 107 to the waste-liquid tank 94 is dried. Therefore, an undesired flow of electricity over or through the discharge line 106 can reliably be prevented from occurring when it is desired to apply a high voltage to conductive paint of a new color after completion of the cleaning process. As a consequence, the high voltage applied to the conductive paint can be prevented from dropping, and the electrostatic spray painting process can be carried out with high accuracy. If a process for drying the discharge line 106 is carried out during an interval in which even the spray gun 46 is filled with new conductive paint via the delivery line 44 after the delivery line 44 has been washed, then such a drying process can efficiently be performed.

If the discharge line 106 is dried after it has been washed with the cleaning liquid supplied from the third flush valve mechanism 110, then an undesired flow of electricity over or through resin components of paint, which are adhered to the inner surface of the discharge line 106, can more reliably be prevented. This is further preferred in view of its convenience that the undesired flow of electricity can be avoided.

Figure 12:
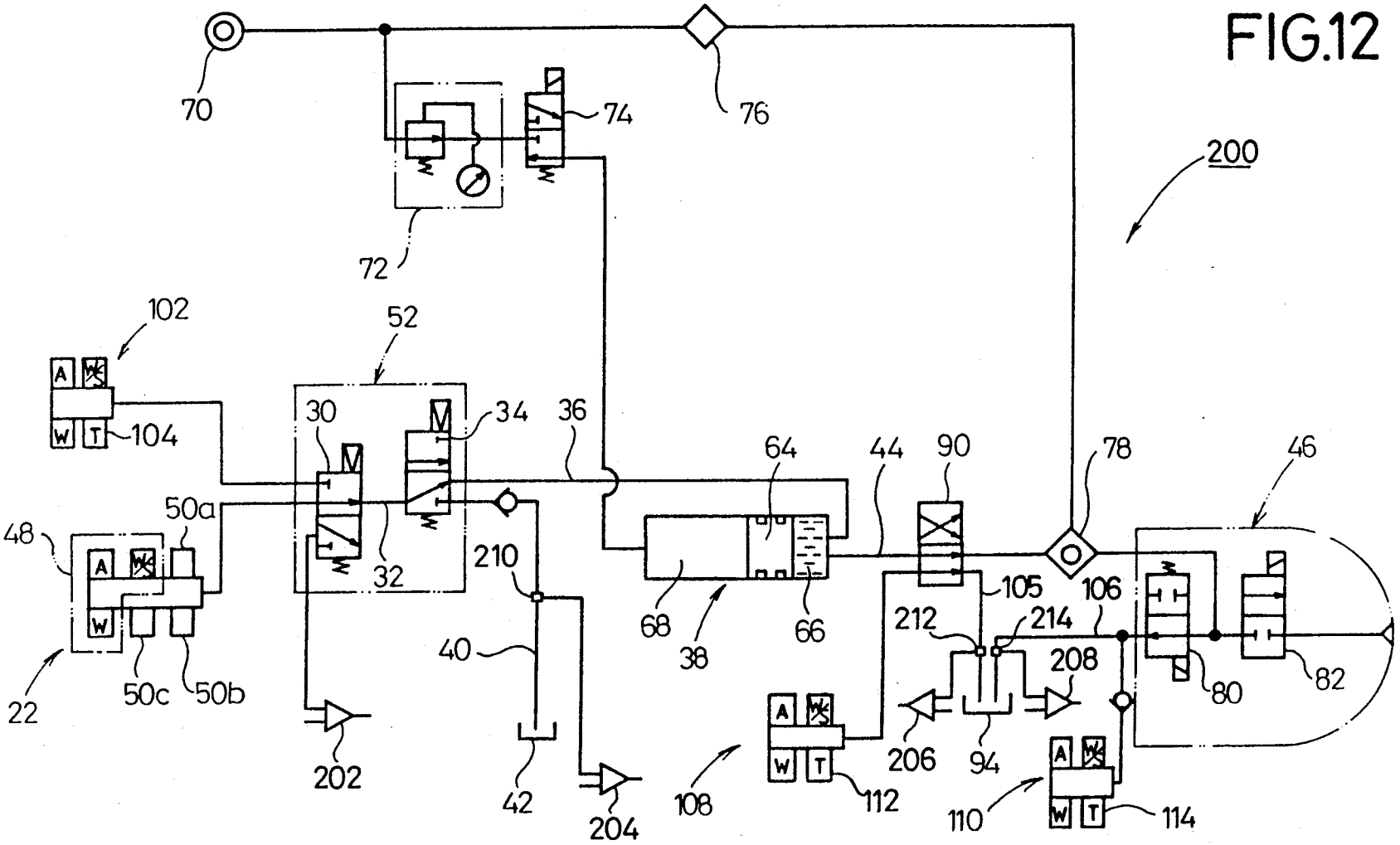
FIG. 12 is a diagram schematically depicting an electrostatic spray painting apparatus for carrying out an electrostatic spray painting method according to a fourth embodiment of the present invention.

An electrostatic spray painting method according to a fourth embodiment of the present invention will now be described below with reference to FIG. 12. Incidentally, the same reference numerals as those employed in the electrostatic spray painting apparatus 100 shown in FIG. 11 show the same elements of structure as those shown in FIG. 12, and their detailed description will therefore be omitted.

An electrostatic spray painting apparatus 200 according to the fourth embodiment comprises a first comparator 202 for detecting the value of leakage current induced between the first and second three-way changeover valves 30 and 34 of the block valve mechanism 52, a second comparator 204 for detecting the value of leakage current over or through the discharge line 40, a third comparator 206 for detecting the value of leakage current over or through the discharge line 105, and a fourth comparator 208 for detecting the value of leakage current over or through the discharge line 106. The first comparator 202 is electrically connected to the first three-way changeover valve 30, whereas the second through fourth comparators 204 to 208 are electrically connected to metal connectors 210, 212, 214 disposed in intermediate portions of the discharge lines 40, 105, 106, respectively.

In the electrostatic spray painting apparatus 200 constructed as described above, the value of the leakage current flowing through each of portions to which the resin components tend to be adhered via the first through fourth comparators 202 to 208—i.e., the block line 32 of the block valve mechanism 52, and each of the discharge lines 40, 105, 106—is detected. When each value of the leakage current reaches a predetermined reference value or above, the thinner and cleaning liquid may be supplied to any one of the discharge lines 40, 105, 106, at which each value of the leakage current flowing in the discharge lines 40, 105, 106 has reached the reference value or greater as described above after completion of the electrostatic spray painting cycle.

Accordingly, in the fourth embodiment, each of the parts to be washed with the thinner can automatically and reliably be detected by detecting the value of the leakage current flowing through the portions to which the resin components tend to be adhered. Therefore, the entire electrostatic spray painting process can efficiently be carried out.

The electrostatic spray painting methods and the electrostatic spray painting apparatuses according to the first to fourth embodiments of the present invention can bring about the following advantageous effects.

According to one effect of the present invention, after a predetermined amount of water-based paint is supplied via a feed line to an intermediate reservoir from a grounded water-based paint feed source, an electrically-insulated portion formed in at least a part of the feed line is washed with deionized water having specific electric conductivity lower than given specific electric conductivity. Therefore, the water-based paint feed source and the intermediate reservoir can electrically be insulated from each other even under the condition of the deionized water being not fully removed from the electrically-insulated portion by drying, i.e., by carrying out only a deionized water removing process. It is thus possible to carry out a voltage block producing process in a short period of time, thereby making it possible to efficiently and easily the entire spray painting process.

According to another effect of the present invention, at least the electrically-insulated portion is washed with a hydrophilic solvent alone after the water-based paint is supplied to the intermediate reservoir from the grounded water-based paint feed source. Therefore, the detergent action with respect to the electrically-insulated portion by the hydrophilic solvent is greatly improved as compared with a case in which either the water or the cleaning liquid composed principally of water is used, thereby making it possible to reliably clean the electrically-insulated portion in a short period of time. Further, since the specific electric conductivity of the hydrophilic solvent is lower than that of the deionized water, the water-based paint feed source and the intermediate reservoir is electrically separated from each other in a state in which the hydrophilic solvent is not fully dried. As a consequence, the cleaning time can further be shortened. Accordingly, the entire spray painting process can efficiently and easily be carried out.

According to a further effect of the present invention, at least the electrically-insulated portion is washed with a thinner solvent after a predetermined number of electrostatic spray painting cycles are carried out. Therefore, the resin components of the water-based paint, which are apt to adhere to the inner peripheral wall of the electrically-insulated portion, are dissolved. Thus, the resin components do not remain in the electrically-insulated portion. It is also possible to reliably prevent an undesired flow of electricity over or through the resin components and to effectively prevent a failure in painting from occurring owing to the adhesion of the resin components to an object or work to be coated with paint. As a result, the electrostatic spray painting process can be carried out with high accuracy.

According to a still further effect of the present invention, when the value of leakage current over or through at least the electrically-insulated portion is measured and the value thus measured is more than or equal to the reference value, at least the electrically-insulated portion is washed with the thinner solvent after completion of an electrostatic spray painting process. It is therefore possible to reliably prevent an undesired flow of electricity over or through the electrically-insulated portion. In addition, the cleaning work using the thinner solvent can more efficiently be carried out.

According to a still further effect of the present invention, the electrostatic spray painting apparatus according to the present invention can reliably perform a process for washing the electrically-insulated portion with a view toward selectively activating the thinner solvent feed means so as to reliably remove resin components of paint, which remain in the electrically-insulated portion.

According to a still further effect of the present invention, the electrostatic spray painting apparatus according to the present invention can easily and reliably dry a discharge line. Such a drying process is carried out in the following manner. More specifically, when the color selection process and the cleaning process are carried out, a changeover valve is switched to cause a line to communicate with a discharge line, thereby discharging waste liquid such as conductive paint and cleaning liquid which remain in this line to the outside of the discharge line. Thereafter, an air feed mechanism is actuated to supply air to the discharge line, thereby drying the discharge line. Thus, in the electrostatic spray painting apparatus, it is feasible to effectively prevent an undesired flow of electricity over or through the discharge line, which is developed when a high voltage is applied to the conductive paint in order to carry out a spray coating process. Consequently, an electrostatic spray painting process can be carried out with high accuracy by applying a desired high voltage to the conductive paint.

According to a still further effect of the present invention, a first directional control valve is switched to cause a color changeover valve mechanism and a flush valve mechanism to be selectively connected to a block line. In addition, a second directional control valve is switched to cause the block line to be selectively connected to an intermediate reservoir and a waste-liquid tank. It is therefore possible to reduce the number of changeover valves as compared with a case in which two-way changeover valves are used. In addition, the detergent action is superb, and the overall structure of the electrostatic spray painting apparatus can easily be simplified.

It is also unnecessary to cause an arbitrary portion of an insulated line to branch or divide up owing to the use of changeover valves. It is therefore feasible to reliably provide a steady insulated state and to easily simplify the overall structure of an insulation mechanism.

Having now fully described the invention, it will be apparent to those skilled in the art that many changes and modifications can be made without departing from the spirit or scope of the invention as set forth herein.

What is claimed is:

1. An apparatus for electrostatically spray-coating a workpiece with conductive paint, said apparatus comprising:

a color changeover valve mechanism for selectively supplying cleaning liquid, air and the conductive paint through a supply line;

a first flush valve mechanism for selectively supplying the cleaning liquid and the air;

a first directional control valve having an outlet and inlets, said inlets being connected to said supply line and a feed line extending from said color changeover valve mechanism and said flush valve mechanism, respectively;

a block line made of an insulating material and having a first end connected to said outlet of said first directional control valve, said block line includes a second end in communication with said first end;

a second directional control valve having outlets and an inlet, said inlet being connected to the second end of said block line;

an intermediate reservoir connected via a second feed line to one of the outlets of said second directional control valve;

a waste-liquid tank connected via a first discharge line to a second one of the outlets of said second directional control valve;

a spray gun connected via a delivery line to said intermediate reservoir;

a second discharge line branched from said delivery line via a changeover valve;

a second flush valve mechanism selectively supplying at least cleaning liquid and air to said second discharge line, said second flush valve mechanism being provided separately from said color changeover valve mechanism for said supply line; and means for applying a high voltage to the conductive paint between said second directional control valve and said spray gun.

2. The apparatus according to claim 1, and further comprising leakage current measuring means provided on said second discharge line, wherein the cleaning liquid for removing a resin component of the conductive paint remaining in said second discharge line can be supplied from said second flush valve mechanism into said second discharge line when a measured value outputted by said leakage current measuring means exceeds a predetermined value.

3. An apparatus for electrostatically spray-coating a workpiece with conductive paint, said apparatus comprising:

a grounded conductive paint feed source for supplying the paint through a supply line;

an intermediate reservoir for temporarily storing the conductive paint therein and for delivering the conductive paint stored therein to a spray gun; and an insulation mechanism for electrically insulating said conductive paint feed source from said intermediate reservoir, said insulation mechanism comprising:

a first three-way changeover valve having first and second ports connected to said conductive paint feed source and a first flush valve respectively, and a third port connected to one end of an insulated line and capable of selectively communicating with said first and second ports;

a second three-way changeover valve having a fourth port connected to the other end of said insulated line, and fifth and sixth ports connected to said intermediate reservoir and a waste-liquid tank respectively and said fifth and sixth ports being capable of selectively communicating with said fourth port;

a spray gun connected via a delivery line to said intermediate reservoir;

a discharge line branched from said delivery line via a changeover valve;

a second flush valve selectively supplying at least cleaning liquid and air to said discharge line, said second flush valve being provided separately from said conductive paint feed source for said supply line; and means for applying a high voltage to the conductive paint between said second three-way changeover valve and said spray gun.

4. The apparatus according to claim 2, and further comprising leakage current measuring means provided on said discharge line, wherein the cleaning liquid for removing a resin component of the conductive paint remaining in said discharge line can be supplied from said second flush valve into said discharge line when a measured value outputted by said leakage current measuring means exceeds a predetermined value.

5. An apparatus for electrostatically spray-coating a workpiece with water-based conductive paint, said apparatus comprising:

a grounded water-based conductive paint feed source;

an intermediate reservoir for temporarily storing the water-based conductive paint therein and for delivering the water-based conductive paint stored therein to a spray gun;

conductive paint feed means for supplying the water-based conductive paint to said intermediate reservoir from said water-based conductive paint feed means, said conductive paint feed means having an electrically-insulated portion formed in at least a part thereof;

means for washing said electrically-insulated portion with thinner solvent;

means for drying said electrically-insulated portion;

leakage current measuring means provided on said electrically-insulated portion, wherein the thinner solvent for removing a resin component of the conductive paint remaining in said electrically-insulated portion can be supplied from said means for washing said electrically-insulated portion into said electrically-insulated portion when a measured value outputted by said leakage current measuring means exceeds a predetermined value; and thinner solvent feed means for supplying the thinner solvent to remove the resin components of the conductive paint, which remain in said electrically-insulated portion.

* * * * *